US006857148B2

(12) United States Patent
Van Raemdonck

(10) Patent No.: US 6,857,148 B2
(45) Date of Patent: Feb. 22, 2005

(54) ADJUSTABLE BED BASE

(75) Inventor: René Van Raemdonck, Zandbergen (BE)

(73) Assignee: Handi-Move Internatinal N.V., Ninove (BE)

( * ) Notice: Subject to any disclaimer, the term of this patent is extended or adjusted under 35 U.S.C. 154(b) by 0 days.

(21) Appl. No.: 10/467,914

(22) PCT Filed: Feb. 13, 2002

(86) PCT No.: PCT/BE02/00016

§ 371 (c)(1),
(2), (4) Date: Aug. 14, 2003

(87) PCT Pub. No.: WO02/064000

PCT Pub. Date: Aug. 22, 2002

(65) Prior Publication Data

US 2005/0005357 A1 Jan. 13, 2005

(30) Foreign Application Priority Data

Feb. 14, 2001 (BE) ..... 2001/0102

(51) Int. Cl.[7] ..... A61G 7/015
(52) U.S. Cl. ..... 5/617; 5/613; 5/616
(58) Field of Search ..... 5/613, 616, 617

(56) References Cited

U.S. PATENT DOCUMENTS

| | | | | | |
|---|---|---|---|---|---|
| 4,371,996 | A | * | 2/1983 | Nahum | 5/618 |
| 4,376,316 | A | * | 3/1983 | Mercier et al. | 5/618 |
| 5,537,701 | A | * | 7/1996 | Elliott | 5/617 |
| 5,906,017 | A | * | 5/1999 | Ferrand et al. | 5/617 |
| 6,347,420 | B2 | * | 2/2002 | Elliott | 5/618 |
| 6,694,549 | B2 | * | 2/2004 | Perez et al. | 5/618 |

* cited by examiner

*Primary Examiner*—Michael Trettel
(74) *Attorney, Agent, or Firm*—Jerold I. Schneider; Dla Piper Rudnick; Gray Cary Us LLP

(57) ABSTRACT

An adjustable bed base (1) for supporting a person (22) on a mattress (17) loosely lying on the bed base, comprising a leg part (2) and a back part (3), connected to each other by an adjusting mechanism (4) which comprises a first part (5) connected to the back part (3) and a second part (6) connected to the leg part (2), the first and second parts engaging each other and being movable with respect to each other along a predetermined curve which is determined such that the back part (3) upon movement tilts with respect to the leg part (2) and is simultaneously moved in longitudinal and height directions of the bed base (1).

11 Claims, 4 Drawing Sheets

ADJUSTABLE BED BASE

CROSS REFERENCE TO RELATED APPLICATIONS

This application is the U.S. National Stage of International Application No. PCT/BE02/00016 filed Feb. 13, 2002, and claims the priority of Belgian Application No. 2001/0102 filed Feb. 14, 2001. The entirety of each of those applications is incorporated herein by reference.

BACKGROUND OF THE INVENTION

The present invention relates to an adjustable bed base according to the preamble of the first claim.

With the bed base can be meant a slatted base or any other base of a bed.

An adjustable bed base is for example known from U.S. Pat. No. 5,537,701. The bed base described in U.S. Pat. No. 5,537,701 comprises a leg part for supporting the lower part of the body of a person lying on the bed base and a back part for supporting the upper part of this person's body. By means of an adjusting mechanism, the back part is adjustable with respect to the leg part between a lying position and an upright position, in which the back part encloses an obtuse angle with the leg part. The adjusting mechanism is constructed such that, upon moving the back part between the lying position and the upright position, the back part pivots with respect to the leg part and is also moved in longitudinal and height directions of the bed base. As a result, a displacement of the head end of a mattress lying on the bed base with respect to the back part and a displacement of the foot end of the mattress with respect to the leg part are prevented.

The bed base described in U.S. Pat. No. 5,537,701 however has the disadvantage that the adjusting mechanism for moving the back part between the lying position and the upright position comprises a complicated construction. This complicated construction is the result of the fact that the adjusting mechanism comprises, on the one hand, parts for accomplishing the pivoting movement of the back part and, on the other hand, parts for accomplishing the displacement of the back part along the longitudinal and height directions of the bed base. This leads to an adjusting mechanism, in which various parts move with respect to each other during the movement of the back part.

Further, a dentist chair is known from DE-A-39 01 379 with a leg part and a back part which are movable with respect to each other. To this end, the dentist chair comprises an adjusting mechanism which enables a rotation of the back part with respect to the leg part about a virtual pivoting axis, which is located in the pelvis of the person being seated in the chair. By this rotation about the virtual pivoting axis is achieved that a displacement of the person with respect to the chair can be prevented.

SUMMARY OF THE INVENTION

It is an aim of the present invention to provide an adjustable bed base with a simplified adjusting mechanism for moving the back part with respect to the leg part between the lying position and the upright position, with which a displacement of the mattress with respect to the bed base is minimised.

This aim is achieved according to the invention with a bed base showing the technical characteristics of the characterising part of the first claim.

In the bed base of the invention, the adjusting mechanism comprises a first part which is fixed to the back part and: a second part which is fixed to the leg part. The first and second parts engage each other and the first part is movable with respect to the second part along a predetermined curve. This curve is determined such, that the back part upon movement tilts with respect to the leg part and is simultaneously moved along the longitudinal and height directions of the bed base. In other words, the different movements of the back part with respect to the leg part are combined into a single movement, namely the movement along the predetermined curve. This curve can be a segment of a circle, an ellipse, a parabola or a hyperbola, or any other curve deemed suitable by the person skilled in the art.

Because the back part is movable with respect to the leg part along the predetermined curve, one achieves that substantially only two parts are movably mounted with respect to each other in the bed base of the invention. The adjusting mechanism comprises significantly less parts which move with respect to each other, so that its weight can be reduced. Because of this reduced weight, a motor of lower power can be used for moving the back part, which results in a lower energy consumption.

The curve along which the first part of the adjusting mechanism is moved with respect to the second part is preferably determined as follows. The bending of a mattress lying on the bed base causes a lengthening of the bottom side of the mattress which contacts the bed base. If the back part and the leg part were connected by means of a conventional hinge, the contact surface on which the mattress lies would shorten or at most remain equal, while the bottom side of the mattress is as it were stretched. This would result in a displacement of the head end of the mattress with respect to the back part and/or a displacement of the foot end of the mattress with respect to the leg part of the bed base.

By the movement from the lying position to the upright position along the predetermined curve, it is made sure that the back part is removed from the leg part, so that the contact surface with the mattress is lengthened. Because of this, it is possible to minimise the displacement of the mattress with respect to the leg and back parts. By applying the predetermined curve, the movement of the back part is optimally adjustable to the lengthening of the bottom side of the mattress. By further taking into account a lengthening of the bottom of the person lying on the mattress, upon bringing him from lying to sitting position, a very comfortable movement can be achieved, in which simultaneously the displacement of the mattress on the bed base and the displacement of the person on the mattress can be minimised.

In the dentist chair described in DE-A-39 01 379, the leg part and the back part are movable with respect to each other along a predetermined curve, namely a segment of a circle. The dentist chair is, however, not provided for supporting a person on a mattress loosely lying on the chair. In the case of the dentist chair, the leg and back parts are each provided with a separate seat. So the problem of the displacement of the mattress does not occur in this case. As a result, DE-A-39 01 379 does not teach how a displacement of a mattress with respect to the leg and/or back parts can be prevented, nor how a displacement of the person on the mattress can be prevented. It is therefore not obvious that a person skilled in the art would apply the teaching of DE-A-39 01 379 to solve the problem of the displacement of the mattress and/or the person, especially since DE-A-39 01 379 relates to a different technical field.

Furthermore, the curve of the dentist chair described in DE-A-39 01 379 is always a segment of a circle, whereas the curve in the bed base of the invention may, apart from a segment of a circle, also be a segment of a parabola, an ellipse or a hyperbola, or any other curve which the person skilled in the art deems suitable for achieving that the movement of the back part can be adjusted as good as possible to the form of the lengthening of the mattress.

In a preferred embodiment of the bed base according to the invention, the predetermined curve is a segment of a circle, the centre of which is located on a virtual axis. This virtual axis extends substantially in cross direction of the bed base and is preferably located in an area between, on the one hand, the separation of the top surfaces of the of the leg and back parts and, on the other hand, the top side of the person's pelvis. The circular shape of the predetermined curve has the advantage that it is easily achievable.

The movement of the back part with respect to the leg part is optimal when the virtual axis extends in cross direction through the pelvis of the person. In this way, the bed base and the person bend about the same axis, so that the person can be brought from lying to sitting position or vice versa in a comfortable way. Namely, by locating the virtual axis in the person's pelvis, the displacement of the mattress with respect to the leg and/or back parts and simultaneously the displacement of the upper and/or lower parts of the person's body with respect to the mattress can be minimised. The circular shape of the curve with the virtual axis in the person's pelvis is the simplest way of achieving this effect according to the invention. However, it should be noted that this effect can also be achieved by a suitable choice of a different shape of the curve, such as for example a suitably chosen segment of an ellipse, a parabola, a hyperbola or any other curve known to the person skilled in the art.

In the case that the curve is a segment of a circle, the virtual axis is located on a fixed location with respect to the leg part. In the other cases mentioned above, the virtual axis moves with respect to the leg part during the movement of the back part. In such case it is desirable that the virtual axis remains within the area of the person's pelvis, for achieving the effect of optimal movement of the back part.

The adjusting mechanism of the bed base according to the invention can be constructed in various ways. In a first preferred embodiment, the first and second parts of the adjusting mechanism are formed by at least one sliding member and at least one groove for receiving the sliding member, the at least one groove having the shape of the curve. A first possibility is that the sliding member is fixed to the back part and that the groove is fixed to the leg part. For moving the back part with respect to the leg part the sliding member is then moved in the groove. A second possibility is that the groove is fixed to the back part and that the sliding member is fixed to the leg part. For moving the back part with respect to the leg part, the groove is then moved over the sliding member.

The sliding member preferably engages the groove on at least two spaced apart points. In this way it can be prevented that the sliding member tilts in the groove. Since the back part is fixed to either the sliding member, or the groove, the sliding member or the groove in itself gives sufficient support for keeping the back part upright, so that no supplemental support has to be provided below the back part for keeping the back part upright.

In a second preferred embodiment of the bed base according to the invention, the first and second parts of the adjusting mechanism are formed by at least one rolling member and at least one groove for receiving the sliding member, the at least one groove having the shape of the curve. By analogy with the first preferred embodiment, the rolling member may be fixed to the back part and the groove to the leg part, or vice versa. By further analogy with the first preferred embodiment, the at least one rolling member is preferably on at least two spaced apart points provided with each time a wheel, which engages in the associated groove.

In a third preferred embodiment of the bed base according to the invention, the first and second parts of the adjusting mechanism are formed by at least one rolling member and at least one rail over which the rolling member is movable, the at least one rail having the shape of the curve. By analogy with the first preferred embodiment, the rolling member may be fixed to the back part and the rail to the leg part, or vice versa. By further analogy with the first preferred embodiment, the at least one rolling member is preferably on at least two spaced apart points provided with each time a pair of wheels which contact opposite sides of the associated rail.

The adjusting mechanism of the bed base ma further be constructed in any other way deemed suitable by the person skilled in the art.

BRIEF DESCRIPTION OF THE DRAWINGS

The bed base according to the invention will be further elucidated by means of the following description and the appended figures.

In the figures, the invention is applied to a slatted base of a bed. The invention may however also be applied to any other base of a bed known to the person skilled in the art.

DETAILED DESCRIPTION

Figure 1A:
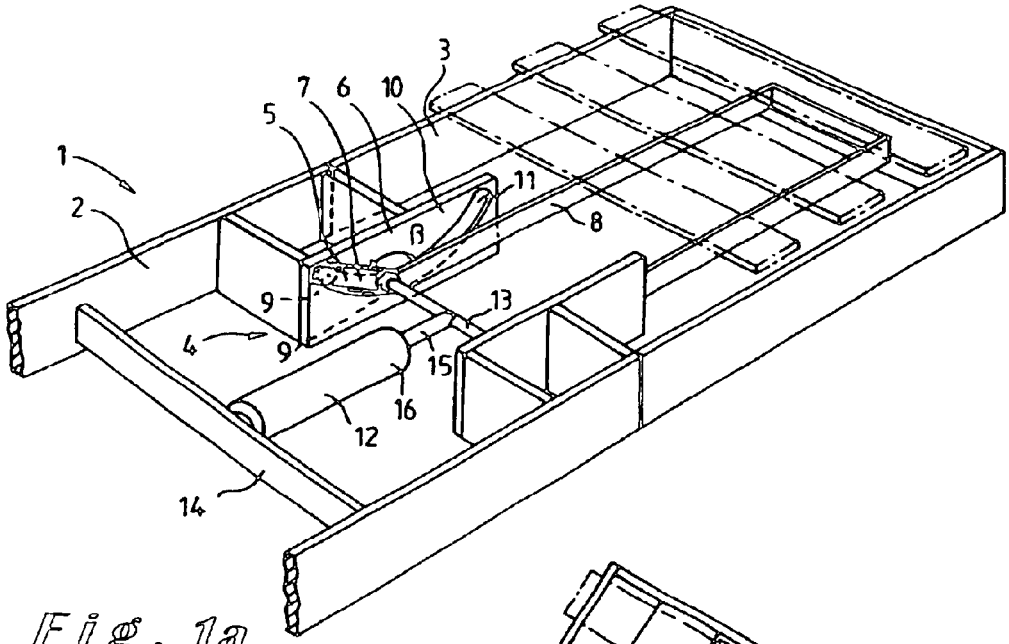
FIGS. 1*a* to 1*c* show a preferred embodiment of the bed base of the invention with the back part respectively in the lying position, an intermediate position and the upright position.
Figure 1B:
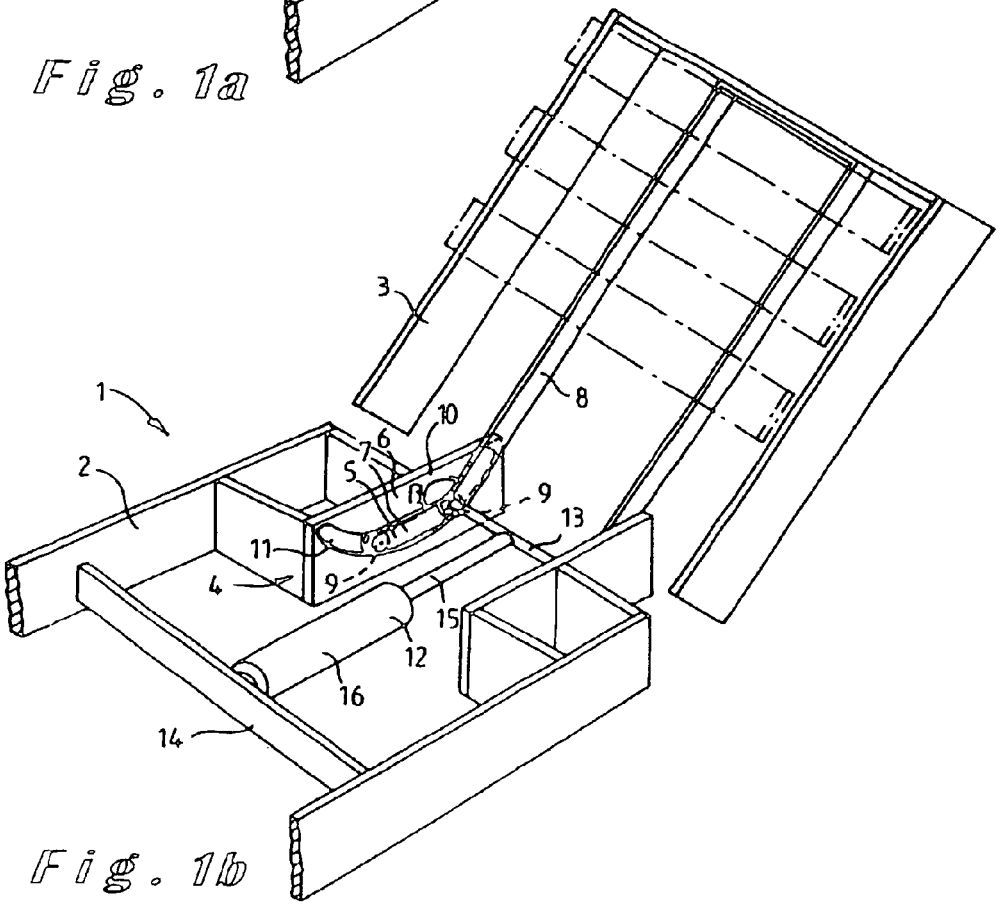
Figure 1C:
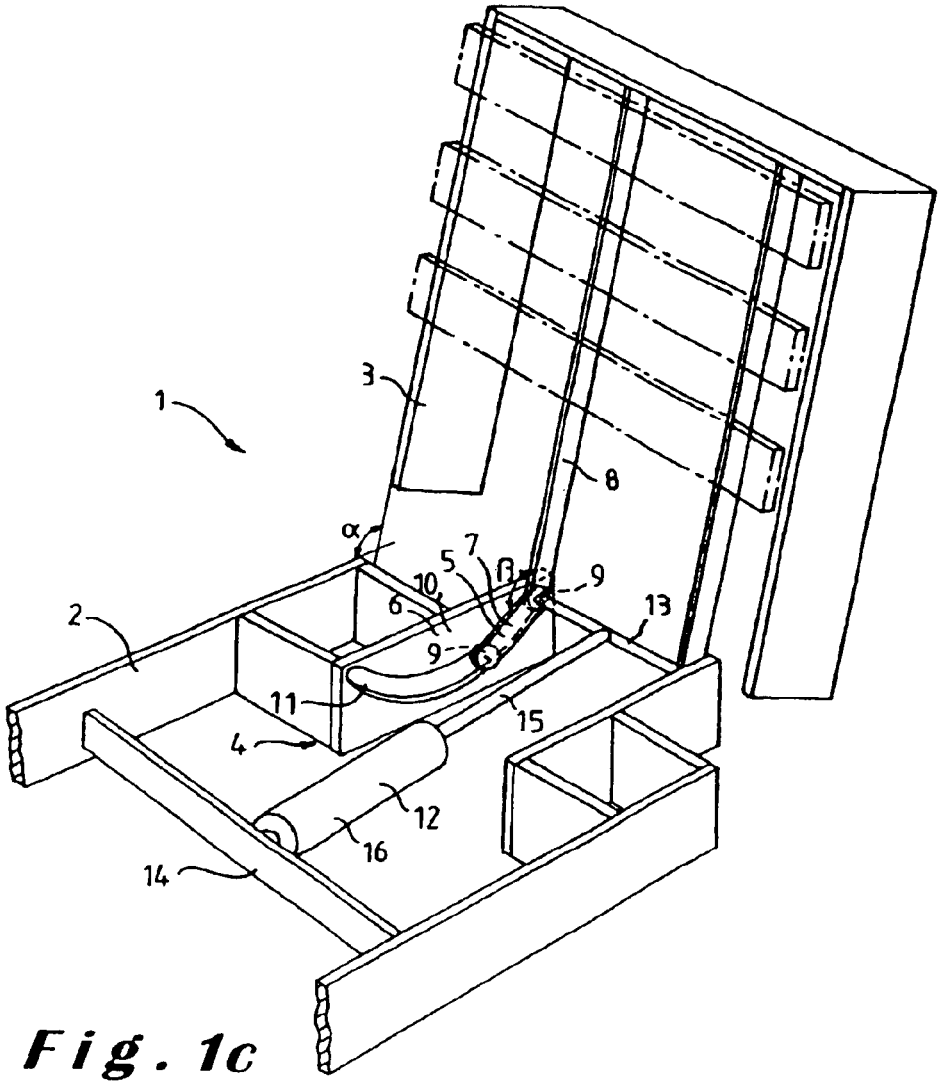

The bed base 1 shown in the FIGS. 1*a–c* is adz/provided for supporting a person 22 on a mattress 17 loosely lying on the bed base 1. The bed base 1 comprises a leg part 2 for supporting the lower part 27 of the person's body and a back part 3 for supporting the upper part 26 of the person's body. The leg part 2 extends from the pelvis to and beyond the person's feet 28. The back part 3 extends from the pelvis to and beyond the person's head. The back part 3 is adjustable with respect to the leg part 2 between a lying position (FIG. 1*a*), in which the back part 3 extends in line with the leg part 2, and an upright position (FIG. 1*c*), in which the back part 3 encloses an obtuse angle $\alpha$ with the leg part 2. The successive FIGS. 1*a–c* show that the back part 3 upon being moved from the lying position to the upright position tilts with respect to the leg part 2 and is simultaneously removed from the leg part 2 along the longitudinal and height directions of the bed base 1.

Figure 3A:
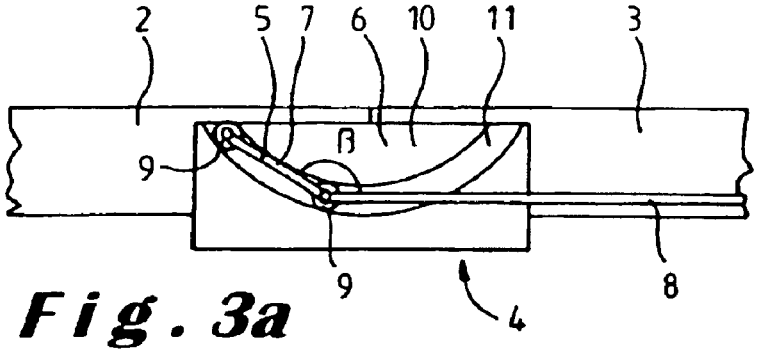
FIGS. 3*a* to 3*c* show the adjusting mechanism of the bed base of FIGS. 1*a* to 1*c* in detail.
Figure 3B:
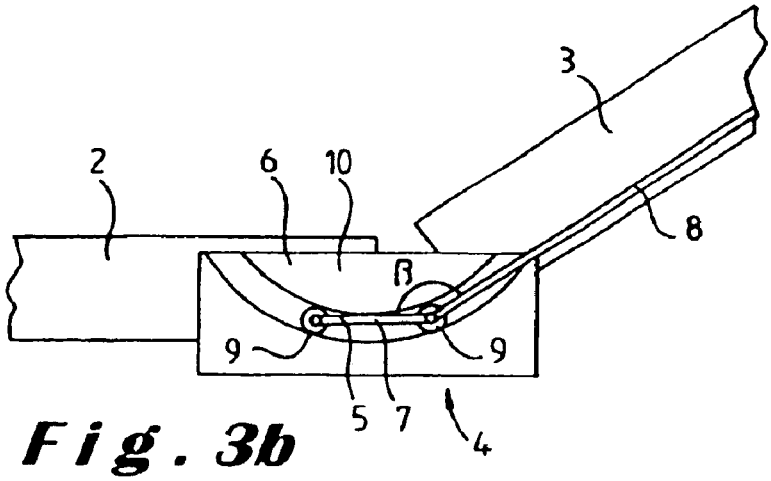
Figure 3C:
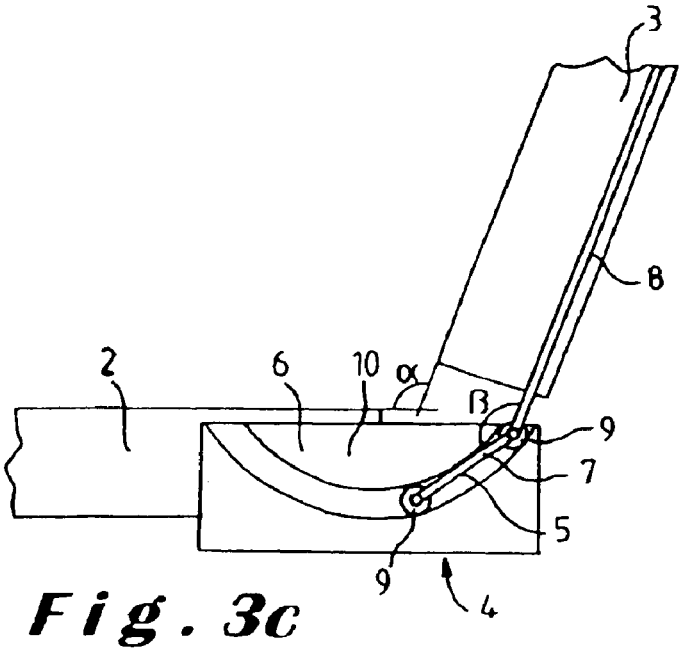

The back part 3 is connected to the leg part 2 by means of an adjusting mechanism 4, which is shown in more detail in FIGS. 3*a* to 3*c*. This comprises a first part 5 which is fixedly mounted, to the back part 3 and a second part 6 which is fixedly mounted to the leg part 2. The first and second parts 5, 6 engage each other and are movable with respect to each other along a predetermined curve. This curve is determined such, that the back part 3 tilts with respect to the leg part 2 upon movement between the lying position and the upright position, and is simultaneously moved along the longitudinal and height directions of the bed base 1. In this way it is achieved, that a displacement of the mattress 17 with respect to the leg part 2 and the back part 3 is minimised.

In the bed base 1 shown in FIGS. 1*a*–c and 3*a*–c, the predetermined curve has the shape of a segment of a circle. The centre of this segment is, located on a virtual axis (not shown), which extends in cross direction of the bed base 1 and is preferably located in an area between, on the one hand, the separation of the top surfaces of the leg part 2 and the back part 3 and, on the other hand, the top side of the pelvis of the person 22. Within this area, the virtual axis may for example extend through the pelvis of the person, or coincide with the bending axis about which the mattress 17 is bent as a result of the movement of the back part 3, or in any other location within the area which is deemed suitable by the person skilled in the art. In the embodiment shown in FIGS. 1*a–c* and 3*a–c*, in which the curve is a segment of a circle, the movement of the back part 3 is optimal when the virtual axis is located in the pelvis of the person 22, since displacements of the upper 26 and lower parts 27 of the person's body with respect to the mattress 17 can then also be prevented. However, it is also possible to choose a segment of an ellipse, a hyperbola or a parabola as shape of the curve, or any other shape known to the person skilled in the art. With such a shape, the virtual axis, about which the back part 3 is tilted, does not have a fixed position, but moves upon the movement of the back part 3 between the lying position and the upright position. In this case the movement is optimal when the virtual axis remains within the area specified above.

The leg part 2 of the bed base 1 of FIG. 1: is preferably fixedly mounted on the bed base 1. However, it may also be movably mounted on the bed base 1 in longitudinal direction and/or!in height direction.

In the bed base 1 of the FIGS. 1*a–c* and 3*a–c*, the first part 5 of the adjusting mechanism comprises two rolling members 7 which are mounted substantially parallel with respect to each other in longitudinal direction of the bed base 1. The rolling members 7 are connected to a supporting element 8 in a fixed angle β, the back part 3 being mounted on the supporting element 8. The second part 6 of the adjusting mechanism comprises two fixed elements 10 which are mounted substantially parallel in longitudinal direction of the bed base 1. Each fixed element 10 is provided with a groove 11, which has the shape of the predetermined curve and is provided for receiving the rolling member 7. The movability of the rolling member 7 in the groove 11 is ensured in that the rolling member 7 comprises each time a wheel 9 on two spaced apart points. As these wheels 9 are spaced apart, it is furthermore achieved that the rolling member 7 cannot tilt in the groove 11 during standstill, so that the rolling member 7 in itself can function as support for keeping the back part 3 upright. This has the advantage that providing a support on the bottom side of the back part 3 for keeping it upright can be prevented.

In the bed base of FIGS. 1*a–c*, the rolling members 7 are fixedly connected to the back part 3 and the fixed elements 1*p* are connected to the leg part 2; Vice versa, the rolling members 7 may also be connected to the leg part 2 and the fixed elements 10 to the back part 3.

The adjusting mechanism 4 of the bed base of FIGS. 1*a–c* comprises two rolling members 7 which engage two grooves 11. The adjusting mechanism 4 may however also comprise more or less rolling members and grooves. Furthermore other embodiments are also possible for the adjusting mechanism, such as for example at least one sliding member, each engaging at least one groove, or at least one rolling member, each engaging around at least one rail, or other.

For moving the back part 3 between the lying position and the upright position, the bed base 1 of FIGS. 1*a–c* is provided with a motor 12. This motor preferably comprises a piston 15 which is movably mounted in a cylinder 16. The free end of the piston 15 is rotatably mounted to a cross bar 13 of the first part 5 of the adjusting mechanism 4. The cylinder is mounted to a cross bar 14 which is fixed, to the leg part. In this way, an outwards movement of the piston 15 towards the outside of the cylinder 16 causes a movement of the back part 3 from the lying position towards the upright position. Vice versa, an inwards movement of the piston 15 towards the inside of the cylinder 16 causes a movement of the back part 3 from the upright position towards the lying position. The motor is preferably a linear electrical motor, but may also be any other motor known to the person skilled in the art, such as for example a hydraulic or pneumatic motor or other.

The different parts of the bed base 1 may be constructed in wood, metal or a plastic material, or any other material deemed suitable by the person skilled in the art.

The operation of the bed base of FIGS. 1*a–c* is as follows. For moving the back part 3 from the lying position to the upright position, the motor 12 is operated such that the piston 15 slides out of the cylinder 16. This causes the rolling members 7 to move in the grooves. The rolling members 7 follow the shape of the grooves 11 and are consequently moved along the curve which determines the shape of the grooves 11. As the rolling members 7 follow the shape of the grooves 11, they are simultaneously displaced and rotated. As the supporting element 8, and consequently also the back part 3, are connected to the rolling members 7 in a fixed angle α, this is also tilted about the virtual axis. Since the rolling members 7 engage in the grooves 11 on two spaced apart points, they are in themselves capable of sufficiently supporting the back part 3 to keep it upright. For moving the back part 3 from the upright position to the lying position it suffices to operate the motor 12 in opposite direction, so that the piston 15 slides into the cylinder 16.

Figure 2A:
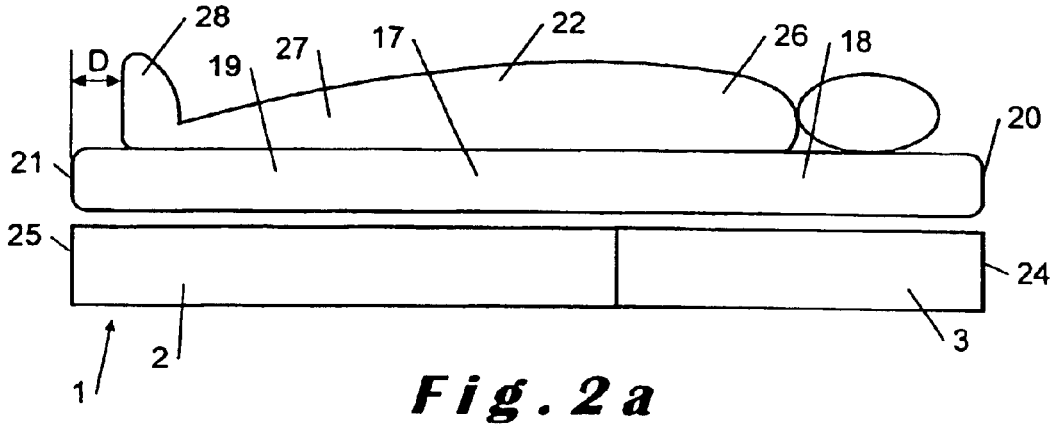
FIGS. 2*a* and 2*b* show how a person is brought from lying to sitting position with the bed base of the invention.
Figure 2B:
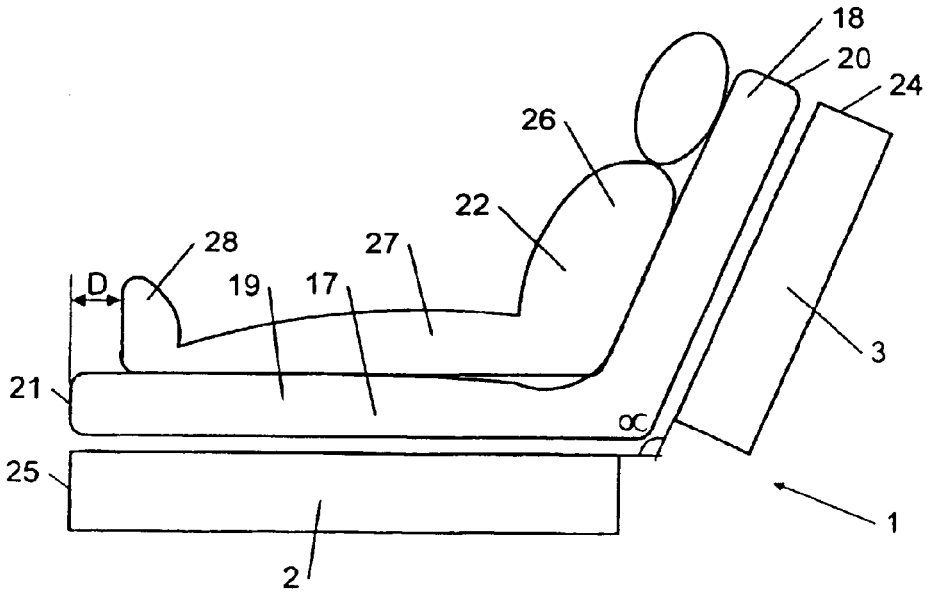

The tilting movement of the back part 3 with respect to the leg part 2 along the predetermined curve is again clarified in FIGS. 2*a–b*, in which the bed base 1 is shown with a mattress 17 and a person 22 on top. The mattress has a front part 18 in contact with the back part 3 and a rear part 19 in contact with the leg part 2 of the bed base 1. As is usual in a bed, the mattress has a length substantially equal to the length of the bed base 1 in the lying position, so that the: head end 20 and the foot end 21 of the mattress are substantially flush with the front and rear ends 24, 25 of the bed base 1. By the tilting movement along the predetermined curve is achieved that the back part 3 and the leg part 2 are removed from each other upon movement from the lying position (FIG. 2*a*) towards the upright position (FIG. 2*b*), so that the top surface of the bed base 1 is uniformly lengthened with the lengthening of the bottom surface of the mattress 17. As a result, displacements of the front 18, respectively rear part 19 of the mattress 17 with respect to the back part 3, respectively the leg part 2 are minimised. In this way it can be prevented, that in the upright position the head end 20 of the mattress 17 protrudes with respect to the front end 24 and that the foot end 21 of the mattress 17 protrudes with respect to the rear end 25 of the bed base 1. Furthermore, the tilting movement along the predetermined curve makes it possible to prevent that upon movement of the back part 3 the upper part 26 of the person's body 22 is displaced on the front part 18 of the mattress 17, and that the lower part 27 of the person's body 22 is displaced on the rear part 19 of the mattress 17. By preventing these displacements, the distance D between the feet 28 of the person 22 and the foot end 21 of the mattress 17 remains substantially constant upon movement from the lying position to the upright position.

What is claimed is:

1. An adjustable bed base for supporting a person on a mattress loosely lying on the bed base, the bed base comprising a leg part for supporting the lower part of the person's body and a back part for supporting the upper part of the person's body, the back and leg parts together forming an uppermost surface of the bed base intended for loosely supporting a mattress, the back part being adjustable between a lying position in which the back part extends substantially in line with the leg part and an upright position in which the back part forms an obtuse angle ($\alpha$) with the leg part, the back part being connected to the leg part by an adjusting mechanism which is provided to tilt the back part with respect to the leg part and simultaneously move the back part in the longitudinal and height directions of the bed base, the movement of the back part with respect to the leg part being defined by a predetermined curve which is determined for preventing displacement of a mattress which is loosely supported on said uppermost surface, the adjusting mechanism comprising a first part fixed on the back part and a second part fixed on the leg part, the first and second parts engaging each other and the first part being movable with respect to the second part along the predetermined curve, one of the first and second parts being shaped according to the curve.

2. An adjustable bed base according to claim 1, characterised in that the predetermined curve is a segment of a circle with a centre located on a virtual axis, the virtual axis extending in cross direction of the bed base and being located in an area between, on the one hand, the separation of the top surfaces of the leg part and the back part and, on the other hand, the top side of the person's pelvis.

3. An adjustable bed base according to claim 2, characterised in that the virtual axis extends in cross direction through the person's pelvis.

4. An adjustable bed base according to claim 1, characterised in that the first and second parts of the adjusting mechanism are formed by at least one sliding member and a groove for receiving the sliding member, the at least one groove having the shape of the curve.

5. An adjustable bed base according to claim 4, characterised in that the at least one sliding member engages in the associated groove on at least two spaced apart points.

6. An adjustable bed base according to claim 2, characterised in that the first and second parts of the adjusting mechanism are formed by at least one rolling member and a groove for receiving the rolling member, the at least one groove having the shape of the curve.

7. An adjustable bed base according to claim 6, characterised in that on at least two spaced apart points the at least one rolling member is provided with a wheel which engages in the associated groove.

8. An adjustable bed base according to claim 1, characterised in that the first and second parts of the adjusting mechanism are formed by at least one rolling member and a rail over which the rolling member is movable, the at least one rail having the shape of the curve.

9. An adjustable bed base according to claim 8, characterised in that on at least two spaced apart points the at least one rolling member is provided with each time a pair of wheels which contact opposite sides of the associated rail.

10. An adjustable bed base according to claim 1, characterised in that the bed base is provided with a motor for moving the back part between the lying position and the upright position.

11. An adjustable bed base according to claim 1, characterised in that the bed base is mounted in a longitudinally movable way on a supporting frame.

* * * * *

UNITED STATES PATENT AND TRADEMARK OFFICE

CERTIFICATE OF CORRECTION

PATENT NO. : 6,857,148 B2
DATED : February 22, 2005
INVENTOR(S) : René Van Raemdonck It is certified that error appears in the above-identified patent and that said Letters Patent is hereby corrected as shown below:

Title page,
Item [73], Assignee, should read -- Handi-Move International N.V. --.

Column 1,
Line 67, "the back part and: a" should read -- the back part and a --.

Column 5,
Line 8, "The centre of this segment is, located" should read -- The centre of this segment is located --;
Line 33, change "The leg part 2 of the bed base 1 of FIG. 1: is" should read -- The leg part 2 of the bed base 1 of FIG 1 is --;
Line 61, "1*p* are connected" should read -- 10 are connected --.

Column 8,
Line 14, "An adjustable bed base according to claim 2" should read -- An adjustable bed base according to claim 1 --.

Signed and Sealed this

Eleventh Day of October , 2005

JON W. DUDAS
*Director of the United States Patent and Trademark Office*